United States Patent [19]

Kitagawa

[11] 4,191,324

[45] Mar. 4, 1980

[54] COLLAPSIBLE BOX

[76] Inventor: Yoshiko Kitagawa, 23-1, Yoyogi 2-chome, Shibuya-ku, Tokyo, Japan

[21] Appl. No.: 936,805

[22] Filed: Aug. 25, 1978

[30] Foreign Application Priority Data

Aug. 27, 1977 [JP] Japan ..... 52-115217[U]
Sep. 8, 1977 [JP] Japan ..... 52-120763[U]

[51] Int. Cl.[2] ..... B65D 5/36

[52] U.S. Cl. ..... 229/22; 229/8; 229/41 R

[58] Field of Search ..... 229/8, 41 R, 22

[56] References Cited

U.S. PATENT DOCUMENTS

| | | | |
|---|---|---|---|
| 1,759,613 | 5/1930 | Green | 229/8 |
| 2,067,998 | 1/1937 | Williamson | 229/8 X |
| 2,341,056 | 2/1944 | Moore | 229/22 X |
| 2,855,607 | 10/1958 | Sullivan | 229/8 X |
| 2,966,293 | 12/1960 | Goldsholl | 229/8 X |
| 3,079,062 | 2/1963 | Craddock et al. | 229/22 X |
| 3,302,845 | 2/1967 | Gould | 229/8 X |
| 3,381,885 | 5/1968 | Seiferth et al. | 229/8 X |
| 3,558,034 | 1/1971 | Benachi | 229/8 |

*Primary Examiner*—Davis T. Moorhead
*Attorney, Agent, or Firm*—Frishauf, Holtz, Goodman & Woodward

[57] ABSTRACT

A collapsible box made of paperboard or foil-laminated paperboard or the like which takes little space when collapsed and stored, and which can be quickly erected by simple operation to form a box.

19 Claims, 12 Drawing Figures

COLLAPSIBLE BOX

BACKGROUND OF THE INVENTION

This invention relates to a collapsible box or carton made of paperboard or foil-laminated paper board or the like which takes little space when collapsed and stored, and which can be quickly erected by simple operation to form a box. Particularly, this invention relates to a box which can be easily erected by pushing both sides of the box inwardly and simultaneously closed.

SUMMARY OF THE INVENTION

As an improvement on the conventional collapsible boxes, the present invention permits the making of boxes which can be quickly erected by a simple operation. The box of the present invention occupies little space when stored.

BRIEF DESCRIPTION OF THE DRAWINGS

FIG. 1 is a plan view of the box;

FIG. 2 is a plan view of the box which has been glued or adhered but which is folded flat in a storage condition; and FIG. 3 is a perspective view of a fully erected and closed box;

FIG. 5 is a plan view of the box;

FIG. 6 is a plan view of the box which has been glued or adhered but which is folded flat in a storage condition; and FIG. 7 is a perspective view of a fully erected and closed box;

FIG. 8 is a plan view of the box;

FIG. 9 is a perspective view of a fully erected and closed box; and

FIG. 10 is a side elevational view of the erected box; and

FIG. 11 is a plan view of the box; and

FIG. 12 is a perspective view of a fully erected and closed box.

DETAILED DESCRIPTION OF THE INVENTION

This invention relates to a collapsible box consisting of front side wall and back side wall which are foldably connected to each other along the bottom and both sides, fold lines having definite length being lengthwise scored from central portions of top edges of the two side walls, fold lines being slopewise scored from the terminal point of said lines to the bottom corner of the box.

Figure 1:
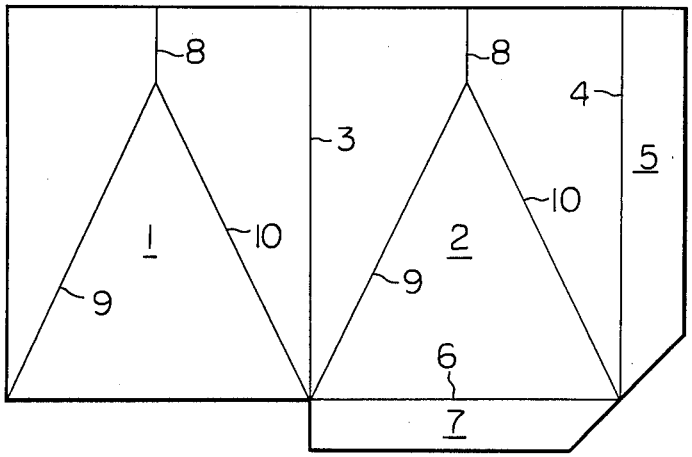
FIGS. 1 to 3 show a collapsible box according to a first example of the present invention.
Figure 2:
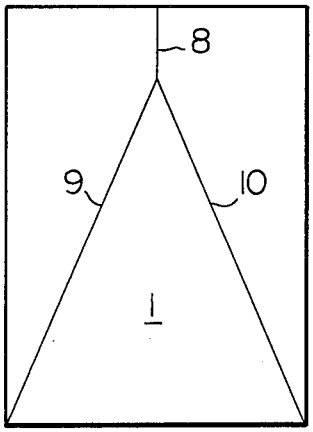
Figure 3:
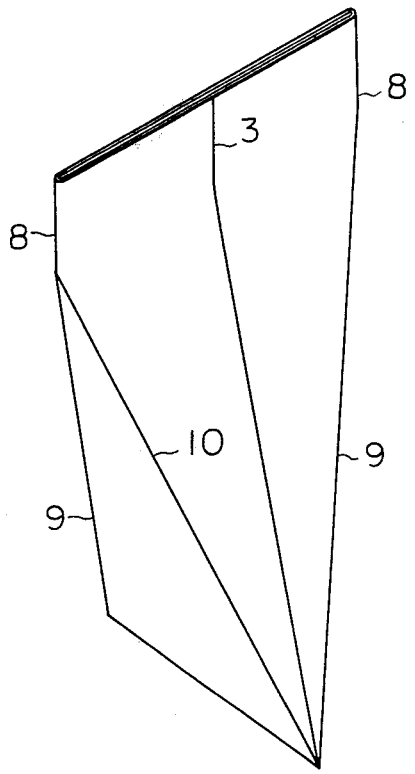

FIGS. 1 to 3 show a collapsible box according to the first example: FIG. 1 is a plan view of the box. The box includes front side wall 1 and back side wall 2. Fold line 3 is scored between said walls 1 and 2. Back side wall 2 is formed with flap portions 5 and 7 via fold lines 4 and 6. Fold lines 8 and 8 having definite length are lengthwise scored from central portions of top edges of the two side walls 1 and 2. Fold lines 9, 9, 10 and 10 are slopewise scored from terminal points of said lines 8 and 8 to the bottom corners of said side walls 1 and 2.

When a collapsible box is to be made, flap portions 5 and 7 are folded on back side wall 2, followed by folding front side wall 1 on back side wall 2 and adhering wall 1 to flap portions 5 and 7. The collapsible box in a flat condition is shown in FIG. 2. When the box in the flat condition is stored and shipped, the box occupies little space.

The flat box as shown in FIG. 2 can be erected by pushing the side edges of the box, namely fold lines 3 and 4 of the box inwardly, and simultaneously closed. A fully erected box is shown in FIG. 3.

Figure 4:
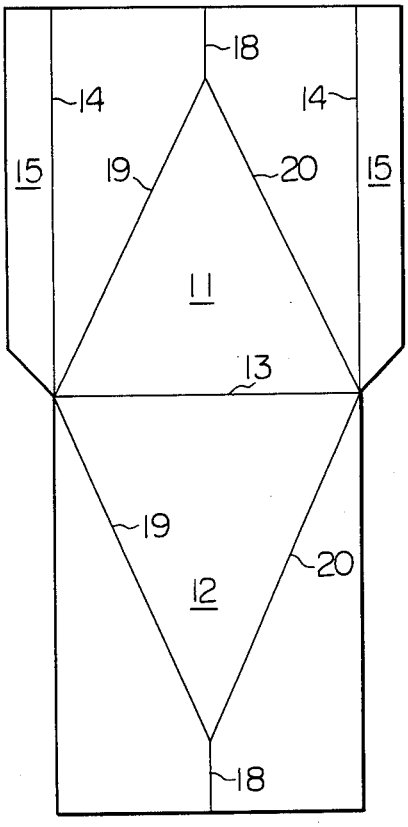
FIG. 4 is a plan view of the box according to a second example.

FIG. 4 is a plan view of the box of the second example. The box includes front and back side walls 11 and 12. Fold line 13 is scored between said walls 11 and 12. Front side wall 11 is formed with flap portions 15 and 15 via fold lines 14 and 14. Fold lines 18 and 18 having definite length are scored from center of top edges of the two side walls. Fold lines 19, 19, 20 and 20 are slopewise scored from terminal points of said lines 8 and 8 to bottom corners of said side walls.

When a collapsible box is to be made, flap portions 15 and 15 are folded on front side wall 11, followed by folding back side wall 12 on front side wall 11 and gluing or adhering wall 12 to flap portions 15 and 15. The box can be in a flat condition. The erecting operation of the box is the same as that of the box in the first example.

Figure 5:
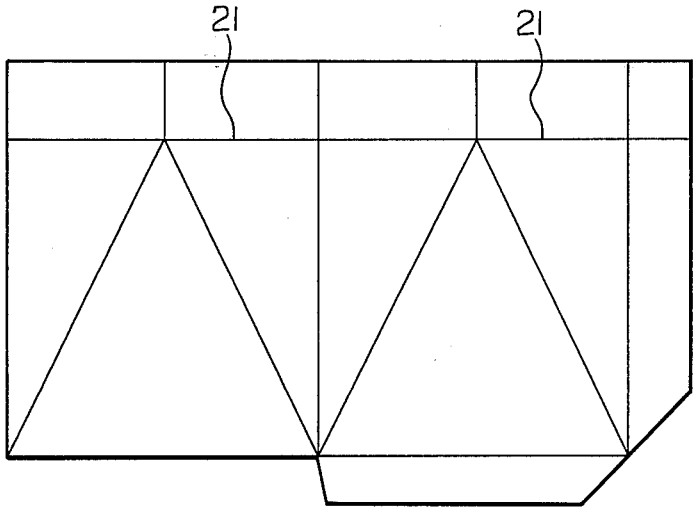
FIGS. 5 to 7 show a collapsible box according to a third example of the present invention.
Figure 6:
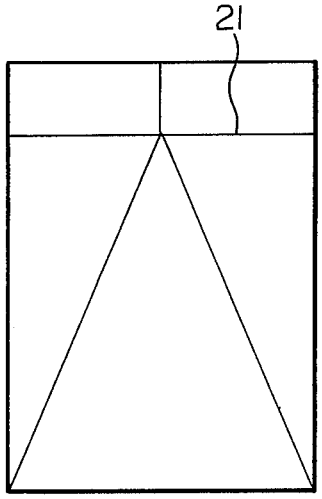
Figure 7:
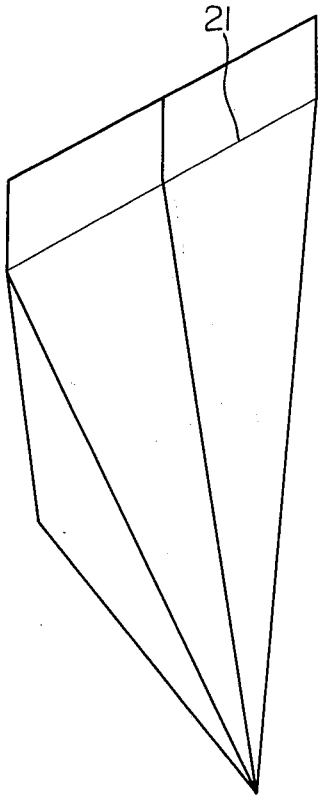

FIGS. 5 to 7 show a collapsible box according to the third example. The box according to the third example is the same as the box of the first example except that fold lines 21 and 21 which pass said terminal point of lines 8 are widthwise scored on the front and back side walls. The processes of making and erecting the box are the same as those for the first box of FIGS. 1–3. Such widthwise fold lines may be scored on the second box of FIG. 4.

Figure 8:
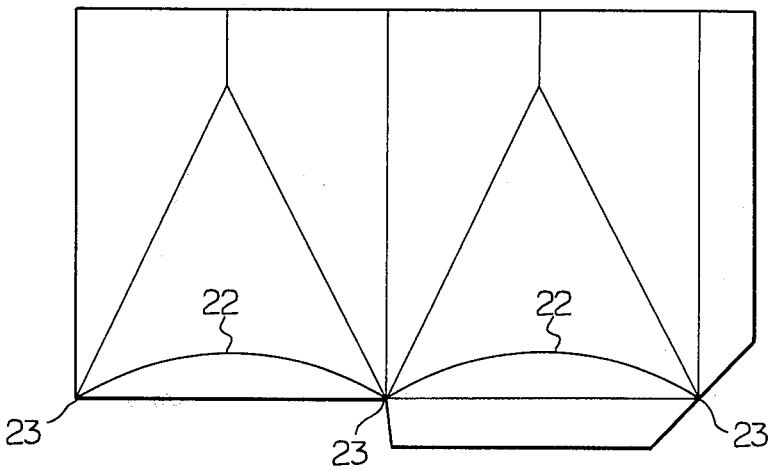
FIGS. 8 to 10 show a collapsible box according to a fourth example.
Figure 9:
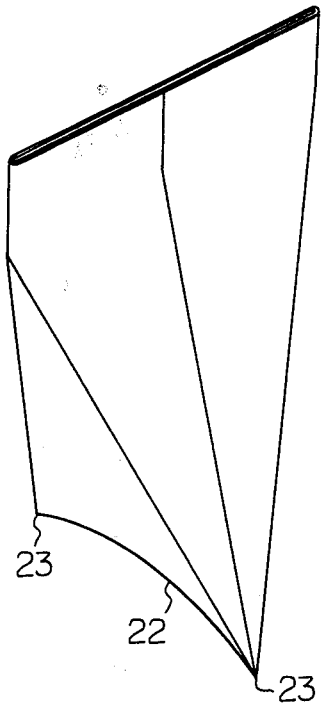
Figure 10:
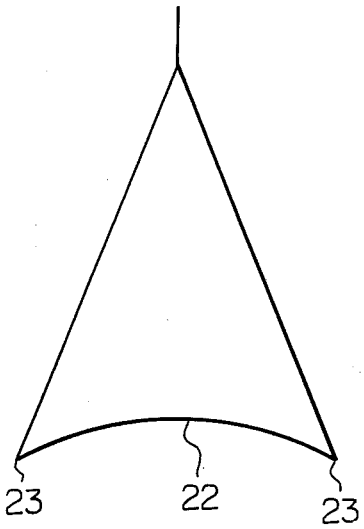

FIGS. 8 to 10 show a collapsible box according to the fourth example. The fourth box is the same as the first box except that the curved fold lines 22 and 22 are scored between the corners 23, 23 and 23. When the fourth box is erected, a curved bottom edge is formed as shown in FIG. 10. It is a matter of course that such curved fold lines may be scored in the second and third boxes.

Figure 11:
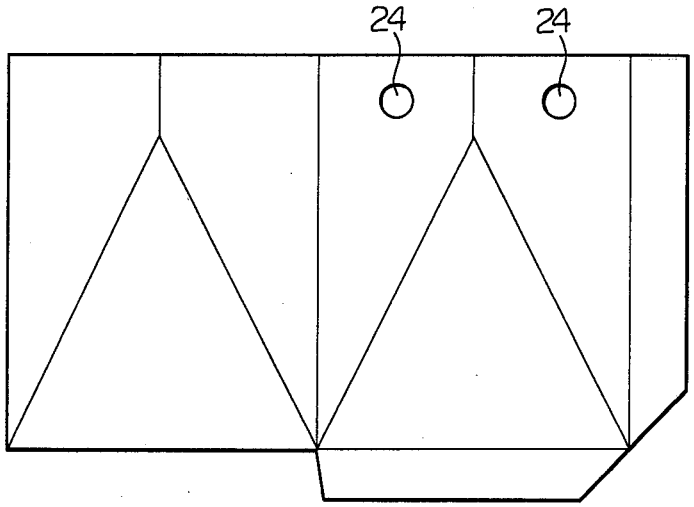
FIGS. 11 and 12 a collapsible box according a fifth example.
Figure 12:
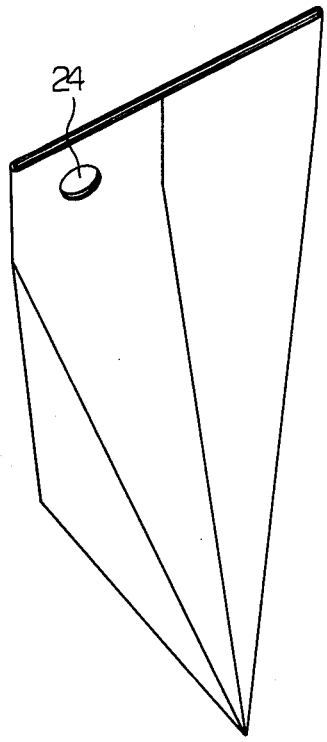

FIGS. 11 and 12 show a collapsible box according to the fifth example. The fifth box is the same as the first box except that holes 24 and 24 are punched in the front and back side walls so that two holes overlap when the box is erected. It is easy to carry the erected box by inserting a finger in the hole. Such holes may be punched in the second, third and fourth boxes.

The boxes of the present invention may be made of paperboard, aluminum foil-laminated paperboard, rigid plastic sheet or rigid leather.

The present box can be erected without using specific parts. The erected box is not easily restored to the flat state. In addition, the box is erected and simultaneously closed. Also, the flat box occupies little space, so shipping and storage of the box is economical.

The present box can be used as a shopping bag or basket. The box can be also used as a packaging container, brief case or hand bag.

What is claimed is:

1. A collapsible box which alternately takes a substantially flat state for storage or an erected state for receiving contents, and which is easily erected from the flat state, comprising:

a substantially rectangular front side wall and a substantially rectangular back side wall which are foldably connected to each other along the bottom and both sides thereof to form a collapsed, substantially flat structure;

first fold lines which are lengthwise scored from the center of the top edge of each of the two side walls and extending toward the bottom edges of each of the two side walls, said first fold lines terminating short of said bottom edges of the side walls and said first fold lines having a sufficient length such that a large area in which the front and back side walls contact each other is formed when the box is erected, said first fold lines being unfolded when the box is in its substantially flat state; and a pair of second fold lines which are slopwise scored on each side wall, said second fold lines of each side wall extending from the terminating point of said first fold line of the respective side wall to respective bottom corners of said side walls, said second fold lines being unfolded when the box is in its substantially flat state;

whereby when opposing side edges of said side walls are pushed inwardly toward each other, said front and back said walls are folded on said first and second fold lines to form an erected box, a large area of said side walls contacting each other to close the top of the erected box and said first fold lines forming side edges of the erected box at the top portion of the erected box.

2. The box as defined in claim 1 further comprising third fold lines which substantially pass through said terminating point of said first fold line and which are widthwise scored on each of said side walls.

3. The box as defined in claim 1 further comprising a further curved fold line on each of said side walls and which is scored between both bottom corners on each of said side walls.

4. The box as defined in claim 1 further comprising a hole formed in each of said front and back side walls so that the holes are in registration when the box is erected.

5. The box as defined in claim 1 wherein said large area of said side walls which contact each other when the box is erected is substantially coextensive with the length of said first fold lines.

6. A collapsible box which alternately takes a substantially flat state for storage or an erected state for receiving contents, and which is easily erected from the flat state, comprising:

a substantially rectangular front side wall (1) and a substantially rectangular back side wall (2);

a first fold line (3) scored between said side walls (1 and 2) and defining a common edge of said side walls;

flap portions (5, 7) extending from at least one (2) of said side walls, second fold lines (4,6) being scored between said flap portions (5, 7) and said at least one side wall (2);

third fold lines (8) which are lengthwise scored from the center of the top edge of each of said two side walls and extending toward the bottom edges of each of the two side walls, said third fold lines terminating short of said bottom edges of the side walls and said third fold lines having a sufficient length such that a large area in which the front and back side walls contact each other is formed when the box is erected, said third fold lines (8) being unfolded when the box is in its substantially flat state; and a pair of fourth fold lines (9,10) which are slopewise scored on each side wall, said fourth fold lines (9,10) extending from the terminating point of said third fold lines (8) of the respective side wall to respective bottom corners of said side walls, said fourth fold lines (9,10) being unfolded when the box is in its substantially flat state;

said side walls being folded about said first fold line (3) to substantially overlie each other and said flap portions (5,7) being folded about respective second fold lines (4,6) and being glued or adhered to the other (1) of said side walls, whereby when opposing side edges of said side walls are pushed inwardly toward each other, said front and back side walls are folded on said third (8) and fourth (9,10) fold lines to form an erected box, a large area of said side walls contacting each other to close the top of the erected box and said third fold lines (8) forming side edges of the erected box at the top portion of the erected box.

7. The box as defined in claim 6 wherein said large area of said side walls which contact each other when the box is erected is substantially coextensive with the length of said third fold lines.

8. The box as defined in claim 6 further comprising fifth fold lines (21) which substantially pass through said terminating point of said third fold lines (8) and which are widthwise scored on each of said side walls (1,2).

9. The box as defined in claim 6 further comprising a further curved fold line (22) on each of said side walls (1,2) and which is scored between both bottom corners on each of said side walls.

10. The box as defined in claim 6 further comprising a hole (24) formed in each of said front and back side walls (1,2) so that the holes (24) are in registration when the box is erected.

11. The box as defined in claim 6 wherein said first fold line (3) defines a common side edge of said side walls.

12. The box as defined in either of claims 6 or 11, wherein said flap portions comprise two flaps, one flap extending from a side edge of said at least one side wall and the other flap extending from the bottom edge of said at least one side wall.

13. The box as defined in claim 12 wherein said flap portions extend from said back side wall (2).

14. The box as defined in claim 6 wherein said first fold line (13 - FIG. 4) defines a common bottom edge of said side walls.

15. The box as defined in either of claims 6 or 14, wherein said flap portions comprise two flaps, one flap extending from the first side edge of said at least one side wall and the other flap extending from the opposite side edge of said at least one side wall.

16. The box as defined in claim 15 wherein said flap portions extend from said front side wall (11 - FIG. 4).

17. The box as defined in either of claims 1 or 6, wherein the box is made of paperboard.

18. The box as defined in either of claims 1 or 6 wherein the box is made of substantially rigid plastic sheet.

19. The box as defined in either of claims 1 or 6 wherein the box is made of substantially rigid leather sheet.

* * * * *